US006036572A

United States Patent [19]

Sze

[11] Patent Number: 6,036,572

[45] Date of Patent: Mar. 14, 2000

[54] DRIVE FOR TOY WITH SUCTION CUP FEET

[76] Inventor: Chau-King Sze, 2/F, 101 Fuk Wing Street, Shamshuipo, Kowloon, The Hong Kong Special Administrative Region of the People's Republic of China

[21] Appl. No.: 09/034,814

[22] Filed: Mar. 4, 1998

[51] Int. Cl.[7] ..... A63H 29/10; A63H 3/20; A63H 7/00

[52] U.S. Cl. ..... 446/177; 446/330; 446/355

[58] Field of Search ..... 446/92, 177, 330, 446/352, 351, 354, 355, 356, 288, 431, 448, 485

[56] References Cited

U.S. PATENT DOCUMENTS

| | | | |
|---|---|---|---|
| 2,918,738 | 12/1959 | Barr | 446/356 X |
| 3,331,463 | 7/1967 | Kramer | 466/355 X |
| 4,083,143 | 4/1978 | Allen | 446/280 |
| 4,312,150 | 1/1982 | Terzian | 446/354 |
| 4,333,259 | 6/1982 | Lin | 446/177 |
| 4,477,998 | 10/1984 | You | 446/177 |
| 4,858,079 | 8/1989 | Ohashi | 446/485 X |
| 5,306,199 | 4/1994 | Locricchio | 446/177 |
| 5,310,377 | 5/1994 | Joja | 446/485 X |
| 5,735,726 | 4/1998 | Cohen | 446/352 X |

FOREIGN PATENT DOCUMENTS

| | | | |
|---|---|---|---|
| 571287 | 2/1933 | Germany | 446/356 |
| 197810 | 10/1978 | Germany | 446/356 |
| 716949 | 10/1954 | United Kingdom | 446/177 |

OTHER PUBLICATIONS

Photo–4(Hong Kong Toys, 1995 first quarter issue) showing a phone cradle manufactured by Weina Manufactory Ltd.

Photo–5 (playthings, 1989 Mar. Issue, p. 50) showing toy vehicles manufactured by Nasta Industries Inc.

"Reactors action vehicles lead Nasta's futuristic lineup of toys" (Playthings, 1989 Mar. issue, p. 50).

Photo–1 (Playthings, 1995 first quarter issue) showing suction cups manufactured by Toy Originator Inc.

Photo–2 (Hong Kong Toys, 1995 first quarter issue) showing a suction cup–suspended doll manufactured by Gara Plastic Products Factory Ltd.

Photo–3 (Hong Kong Toys, 1995 second quarter issue) showing basketball game devices manufactured by Cheung Tai Plastic Factory Ltd.

Photo–4 (Hong Kong Toys, 1995 first quarter issue) showing a phone cradle manufactured by Weina Manufactory Ltd.

Photo–5 (Playthings, Mar. 1989 issue, p. 50) showing toy vehicles manufactured by Nasta Industries Inc.

"Reactors action vehicles lead Nasta's futuristic lineup of toys" (Playthings, Mar. 1989 issue, p. 50).

*Primary Examiner*—D Neal Muir

[57] ABSTRACT

An electrically-powered device incorporated in a toy comprising a motor-driven mechanism and a pair of robotic-limbs each with a resilient sucker to emulate human walking motion on vertical wall or on ceiling, providing the surface is virtually smooth and leveled. The motor and gear assembly is housed in the gearbox while a gear-engaged shaft adjoins a pair of driving wheels, which output the force to a pair of geneva wheels. The geneva wheels that are coupled with the limbs rotate in varied velocity as long as the driving studs of the driving wheel dwells. A lever is disposed in the limb and is actuated by the driven wheel to lift up the sucker that is located at the bottom of the limb, whenever the limb is designated to leave the surface. The pair of driving wheels are properly orientated while one of the geneva wheels is arranged at 180 degree out of phase to its counterpart to ensure either one of the limbs clinched firmly onto the surface.

22 Claims, 15 Drawing Sheets

DRIVE FOR TOY WITH SUCTION CUP FEET

FIELD OF THE INVENTION

This invention relates to all mechanical device incorporated in toys, and more particularly to those motorized robot-related toys.

BACKGROUND OF THE INVENTION

A conventional motorized toy, for various reasons, has been limited to be solely played on ground or on horizontal plane on account of the gravity. Pleasure of playing has been highly impeded due to this limitation unless the hindrance is resolved. This problem is met by several other toy inventions, i.e., toy glider launched by a catapult, scaled-model of helicopter/propeller plane powered by diesel engine. Nevertheless, control of the above-mentioned items requires skill which is not of children's faculty and it is not environmentally acceptable to be played inside a house.

SUMMARY OF THE INVENTION

The present invention seeks resolution to overcome the inherent dilemma of the force required to press a resilient sucker, which withstands the force exerted to it by the weight of the toy, nonetheless ease of releasing of sucker should be called for whenever desired.

The present invention exploits a resilient sucker located at the bottom of each limb, to momentary hold the body of the toy onto a vertical plane in an alternative order. Prior to operation, one of the limbs must be manually stuck onto the plane. After power is switched on, the alternative limb takes turn to advance in pace and hold the toy firmly before the sucker of the first limb is lifted and released. A repetition of the stroke is operated hence advancing the toy in steps. In accordance with the present invention, a phenomenon is observed that less effort is exercised and made realized when the sucker is slightly lifted at the brim before full force is exerted during pressing and releasing. It is implemented by lifting a constituent tab built at the brim of the sucker, which is linked to a lever disposed in the limb whenever the action is entailed.

In a preferred embodiment of the invention, a toy consists of a DC motor, a worm fit to the shaft of the motor, a worm gear and a set of spur gear assembly are encased in the gearbox. The gearbox is contrived of two-half shell made of molded plastic material, and a gear-engaged shaft is seated with both ends protruding out of the gearbox to fit with a pair of driving wheels outside the gearbox. Six driven studs, located on the facet of the driving wheel, are dispersed in radial array with their mutual center concentric with the axle of the gear-engaged shaft. Two constituent ribs, projected from the facet and extended outwardly from the center of the driving wheel, are to lift the lever imposed in the limb at appropriate intervals while an integrated pin administrates the travel of the limb.

Additionally in accordance with the invention, a pair of geneva wheels, each of which comes with a cam in crescent shape and a boss projecting from the surface of the geneva wheel, are affixed to the gearbox and positioned at 180 degree out of phase with each other identified by the position of the boss. The geneva wheels are indexed by the driving studs and revolve in varied speed in respect to the path traveled by the driving studs.

Further in accordance with the invention, each of the limbs is pivoted at the boss of the respective geneva wheel and traverse in a defined locus. The limb comes with a slot along which the delimiting pin of the driving wheel resides. A toggle linkage, a swivel base that adjusts the vertical displacement of the sucker, a spring-action actuator linked to the toggle linkage, a sleeve seated resilient sucker and a metal lever linked to the sucker are assembled and constitute a fully mechanized limb.

BRIEF DESCRIPTION OF THE DRAWINGS

This invention will be further described with reference to the following drawings, in which the outer casing of the toy, location of the battery, location of the on/off switch and all wire connection are not shown as they are considered irrelevant to the present invention.

DETAILED DESCRIPTION OF THE INVENTION

Figure 1:
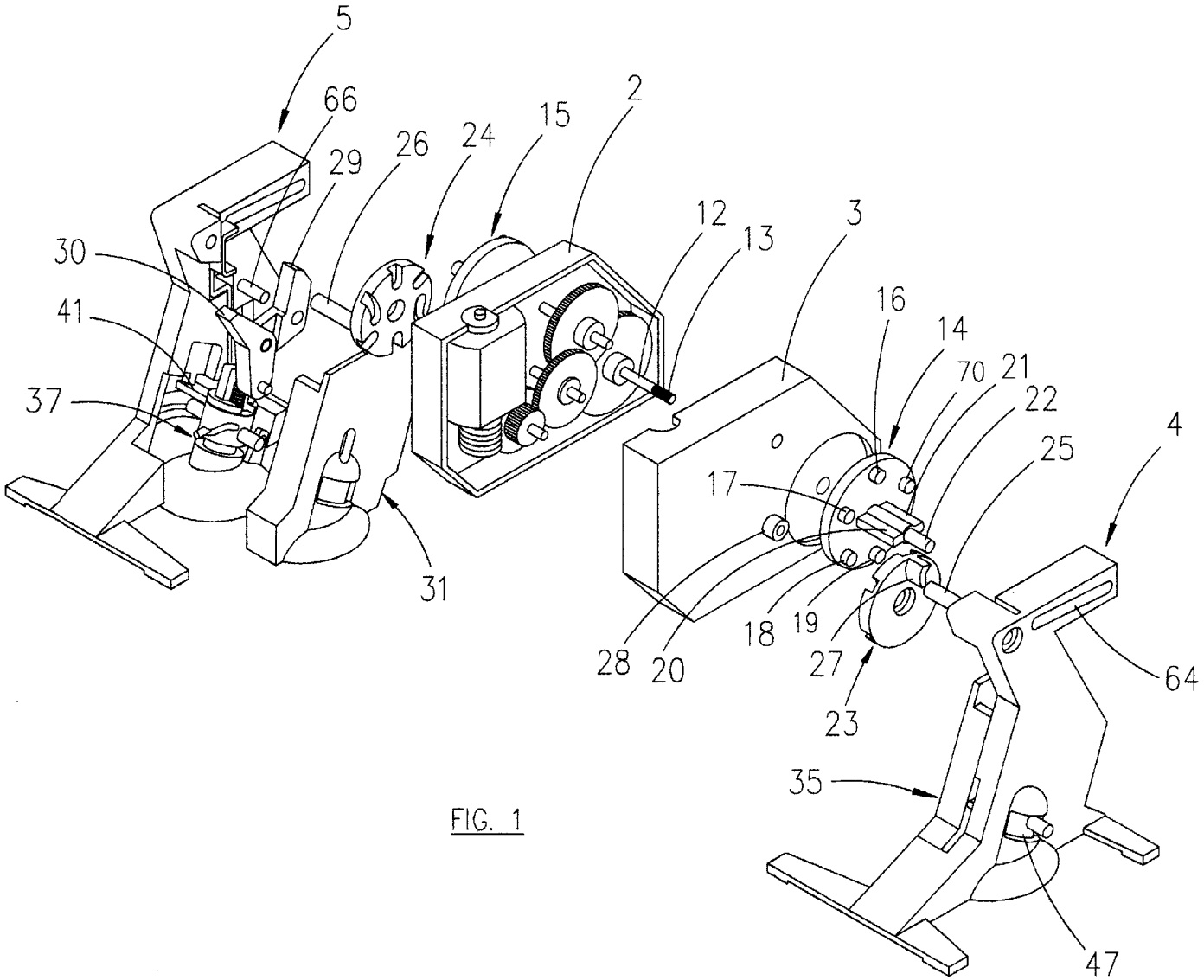
FIG. 1 shows a partly exploded assembly drawing of the toy constructed and operative in accordance with a preferred embodiment of the present invention.
Figure 2D:
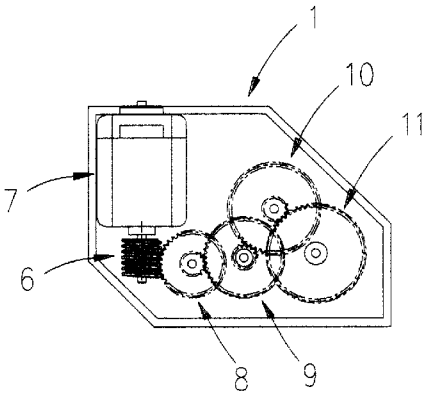
FIG. 2D shows the gear assembly inside the gearbox of FIG. 1.
Figure 2C:
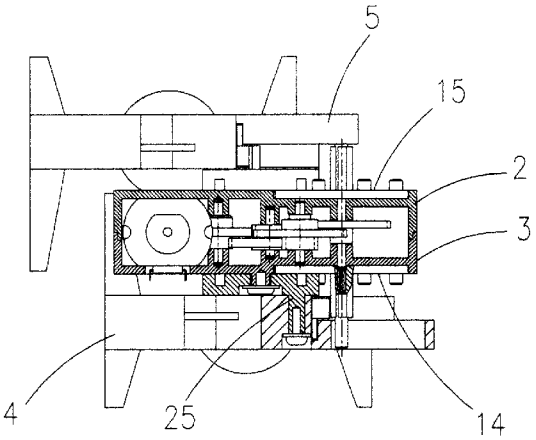
FIGS. 2A, 2B and 2C show front view, side view and a partially sectional top view of FIG. 1.
Figure 2A:
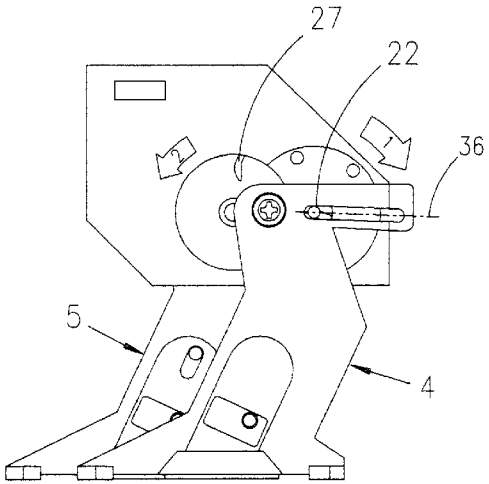
Figure 2B:
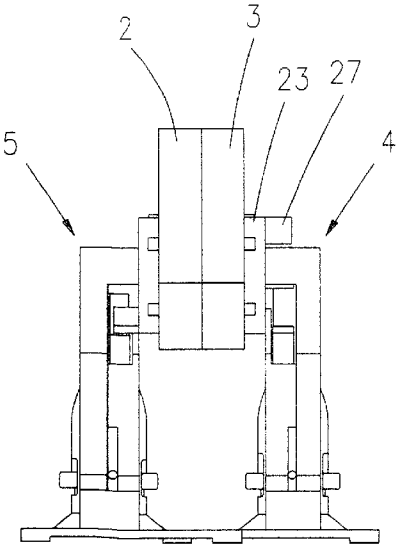

Reference is now made to FIGS. 1A–3A, which illustrates a toy constructed and operative in accordance with a preferred embodiment of the present invention, and comprising a gearbox 1 which is formed of two complimentary half shell 2, 3, and a pair of mechanical limbs 4, 5. In accordance with the present invention, full set of gear assembly including a worm 6 permanently fit onto the shaft of a DC motor 7, four differential gear 8, 9, 10, 11 are installed inside the gearbox. An output-shaft 12 with knurling 13 at both ends, protruding from the gearbox, is mated with a pair of driving wheels 14 and 15. The driving wheels are seated in the recess of the gearbox 1 in proper orientation with each other and rotate in direction 1 upon power switching on. Six driving studs 16, 17, 18, 19, 69, 70 (best shown in FIGS. 8A–8D) built on the facet of each of the driving wheels 14, 15 in polar array, project perpendicular to the plane of the driving wheels 14, 15. A pair of ribs 20, 21 are also built and extend outwardly from the center of the driving wheels 14, 15. A constituent pin 22 extends further and perpendicular to the plane of the driving wheels 14, 15, is to engaged with an elongated slot of the limbs 4, 5 and such arrangement governs the traveling path of the limbs 4, 5.

Further in accordance with a preferred embodiment of the present invention, the geneva wheels 23, 24 are movably mounted onto the boss 28 on each of the gearbox's shells 2 and 3 respectively. Said geneva wheels are indexed by the driving pin 16, 17, 18, 19, 69, 70 of the driving wheels 14, 15 and rotates in direction 2 in varied speed. The orientation of the geneva wheel is defined by the position of the boss 25 or 26 and is arranged at 180 degree out of phase with its counterpart. A crescent-formed cam 27 is built and located at outermost perimeter on the facet of the geneva wheel.

In the illustrated embodiment of the invention, the limbs 4, 5 are movably mounted on the bosses 25, 26 of the respective geneva wheels, while an elongated slot 64 defines a longitudinal axis 36 (FIG. 2A) along which the delimiting pin 22 of the driving wheel resides. Also in accordance with the embodiment of the invention, a set of toggle linkages 29, 30, a sucker assemblies 37 and two sucker-lifting levers 32, 33 are disposed in the limb and encased by the limb-covers 31, 35.

Figure 3A:
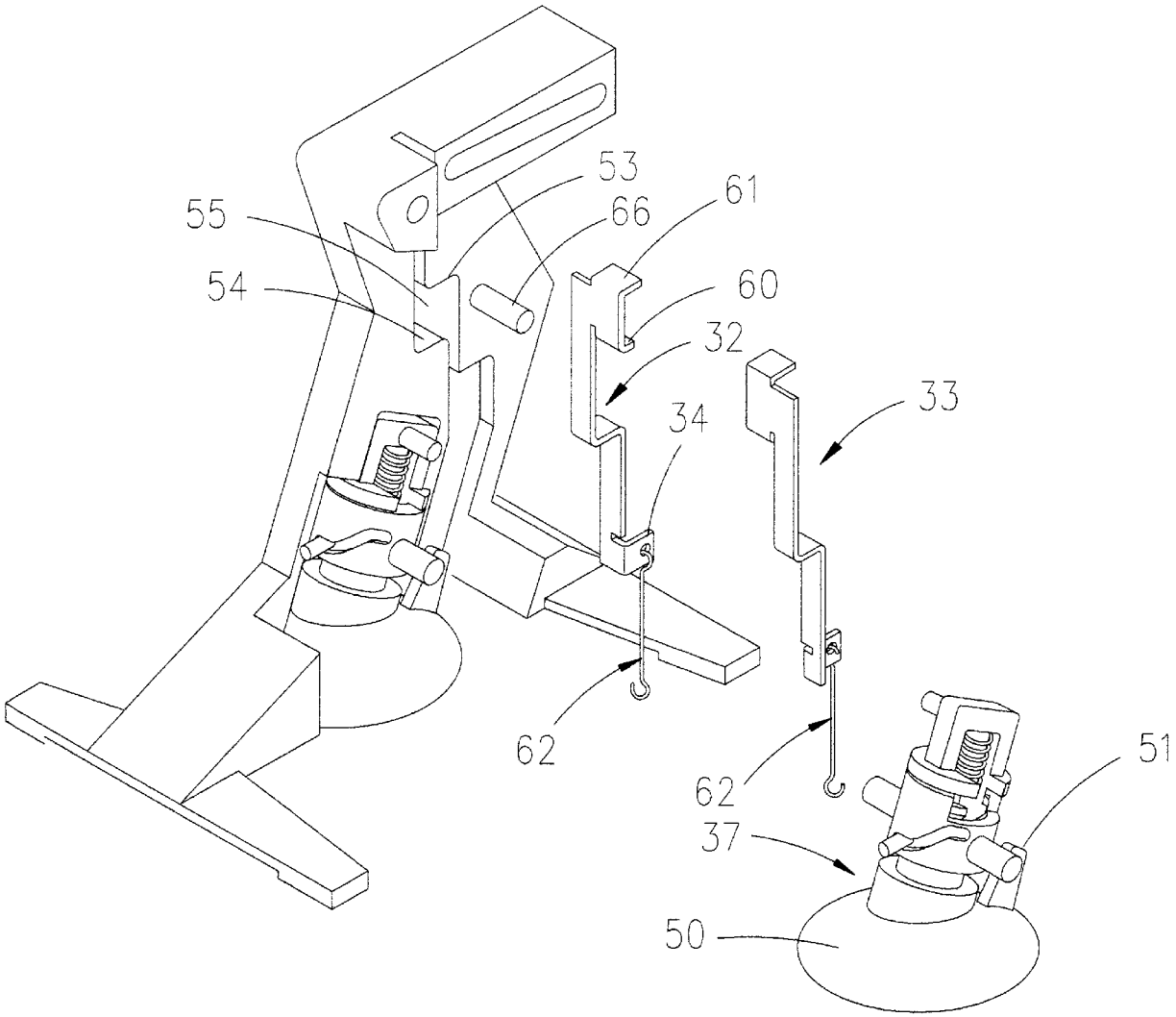
FIG. 3A is an isometric view showing sucker-lifting lever and its mutual relationship with the limb.
Figure 5:
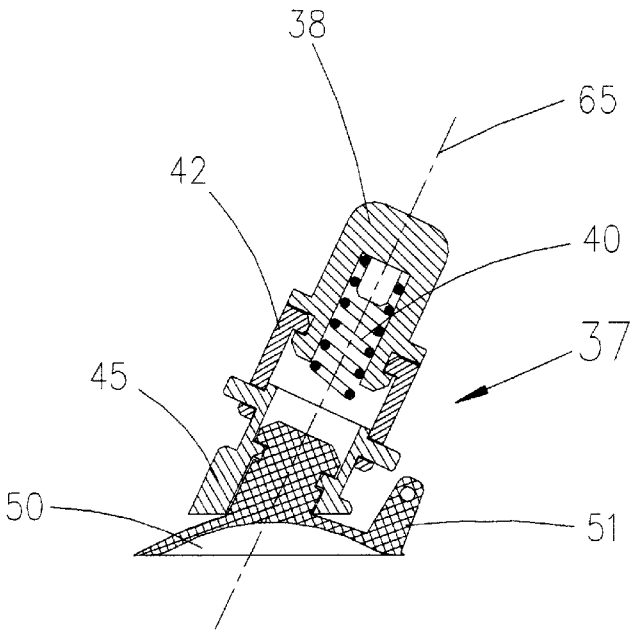
FIG. 5 illustrates a sectional view of FIGS. 4A and 4B.
Figure 4A:
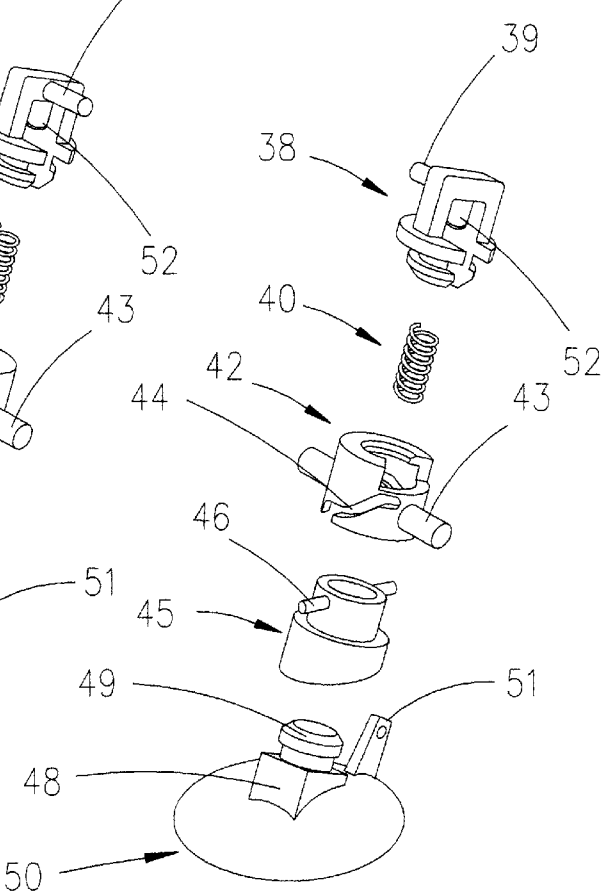
FIGS. 4A and 4B are exploded view of the sucker assembly.
Figure 4B:
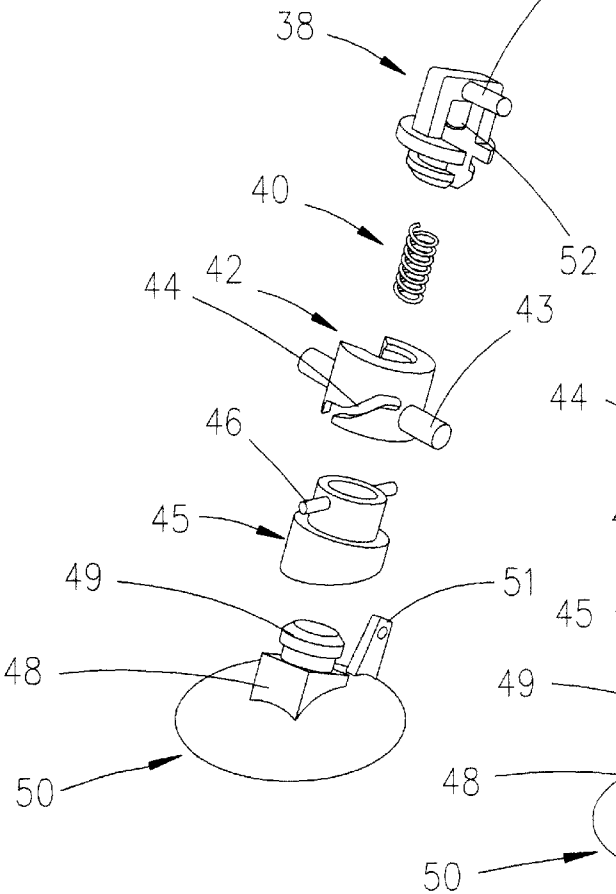
Figure 6A:
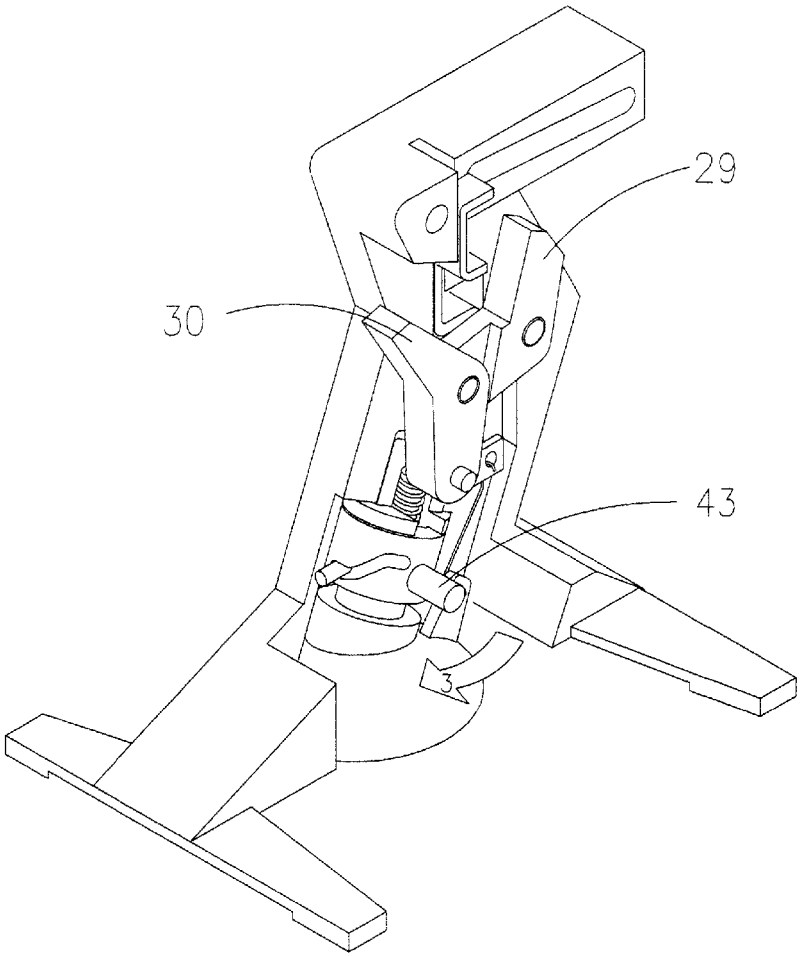
FIGS. 6A and 6B are isometric view showing different vertical displacement of the resilient sucker seated in the sleeve in respect to the axial disposition of the swivel base.
Figure 6B:
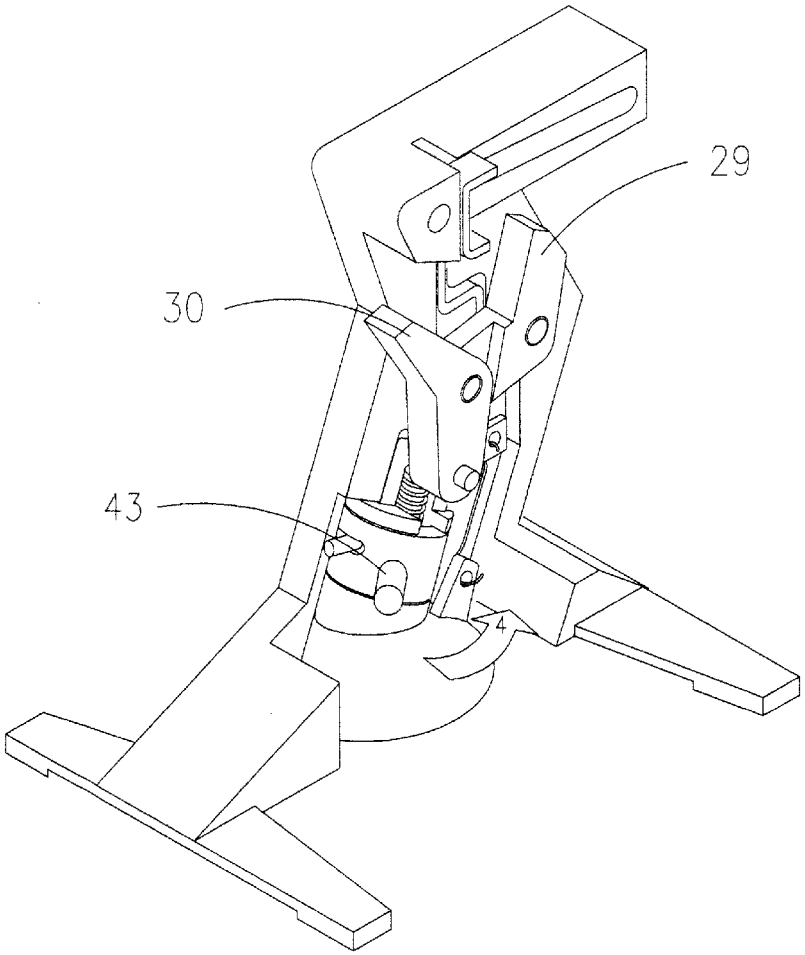

As shown in FIG. 3A, the sucker-lifting levers 32, 33 are, preferably, made of metal and a tab 34 is formed at lower portion to adopt a hook-ended rod 62 which links to a lifting tab 51 built at the brim of a resilient sucker 50. A stepped groove 55 is built in the limb to accommodate the sucker-lifting levers 32, 33, which are freely to move within the limit set by two shoulders 53 and 54.

Reference is now particularly made to FIGS. 4A–6B, which described the maneuver of the sucker assembly 37. In accordance with the present invention, each sucker assemblies 37 are permitted to travel inside the limbs 4, 5 along a longitudinal axis 65 however governed by the status of toggle linkages 29, 30. The sucker assembly 37 comprising an actuator 38, and associate with which a toggle linkage 30 is mounted onto a shaft 39 and thus pivoted, while the other element 29 of the linkage is pivoted and fit to a boss 66 (shown in FIG. 3A) built in the limbs 4, 5, a compression spring 40 is fit to a pin 52 of the actuator 38, with the spring's other end seated against a rib 41 (shown in FIG. 1) built on the limbs 4, 5. The actuator 38 is snapped and engaged with a swivel base 42 from which a pair of bosses 43 extend outwardly for ease of maneuver. The swivel base 42 comes with two "S" shape slots 44 positioned at opposite side, and along which a pair of pins 46 of a slant-bottom sleeve 45 is engaged and travels. The swivel base 42 is allowed to swivel about the axis 65, and more explicitly in the direction 3, 4 in FIG. 6A, within the limit set by the opening 47 (shown in FIG. 1) built on the limbs 4, 5. A resilient sucker 50, which is preferably made of elastomeric plastic, comes with a cubical shank 48 and a snag 49, are fastened firmly in place with the sleeve 45 therein. The sleeve 45 with the sucker 50 is allowed to retract or extend along the longitudinal axis 65 in respect to the axial disposition of the swivel base 42. The retraction of the sucker assembly is only called for when sucking force is not mandatory when the toy is to be played on horizontal plane.

Figure 7C:
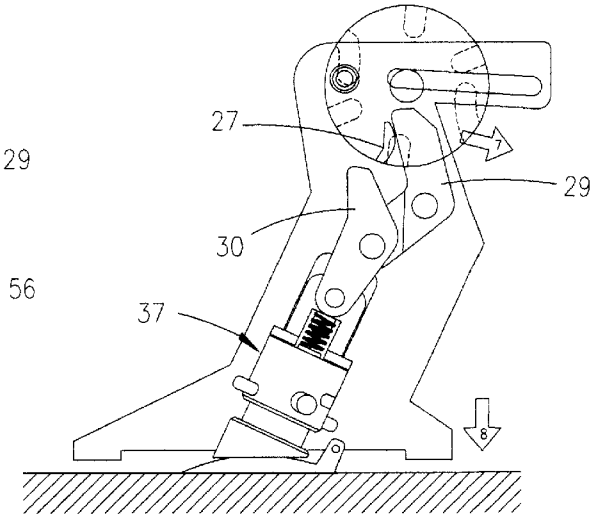
FIGS. 7A, 7B, 7C are simplified pictorial illustration showing different displacement of the sucker assembly in regard to the status of the toggle linkage.
Figure 7B:
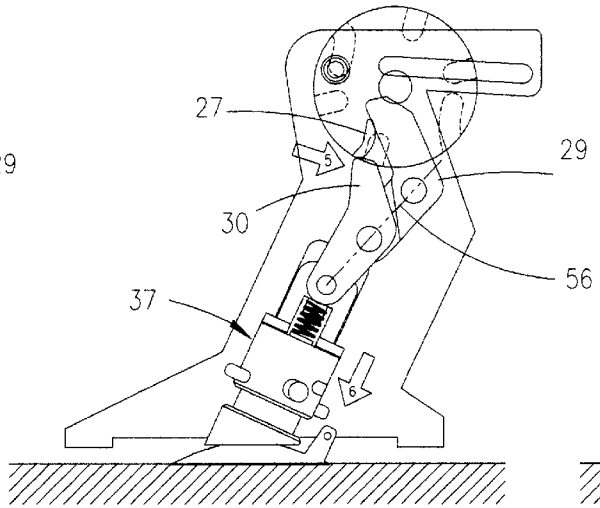
Figure 7A:
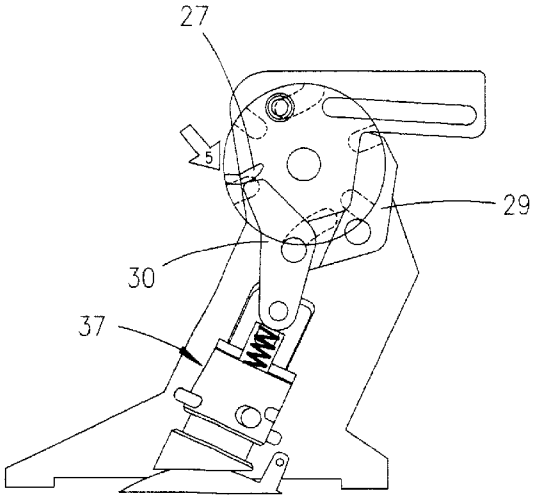
Figure 8B:
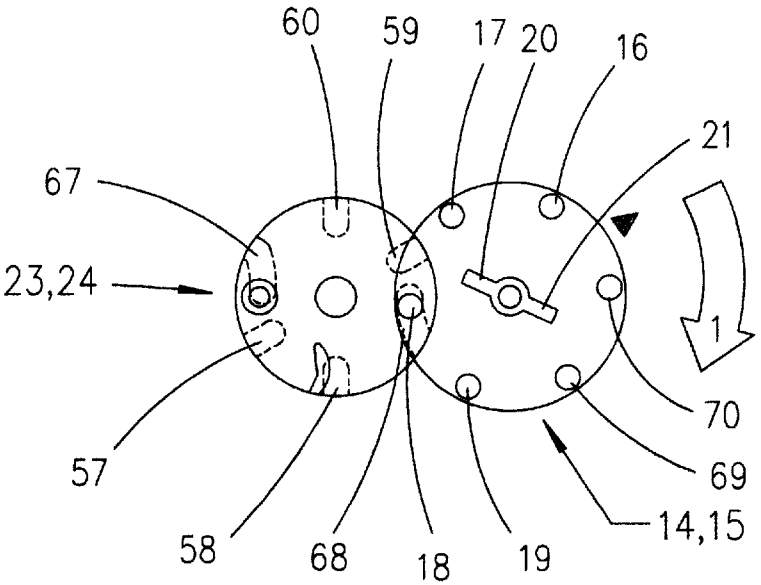
FIGS. 8A, 8B, 8C and 8D are simplified pictorial illustration showing status of the geneva wheel in accordance with different radial position of the driving wheel.
Figure 8A:
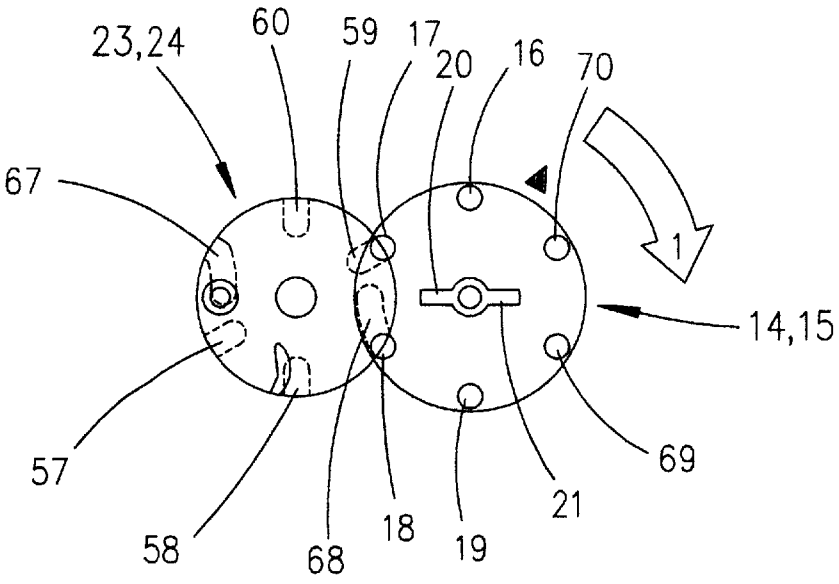
Figure 8D:
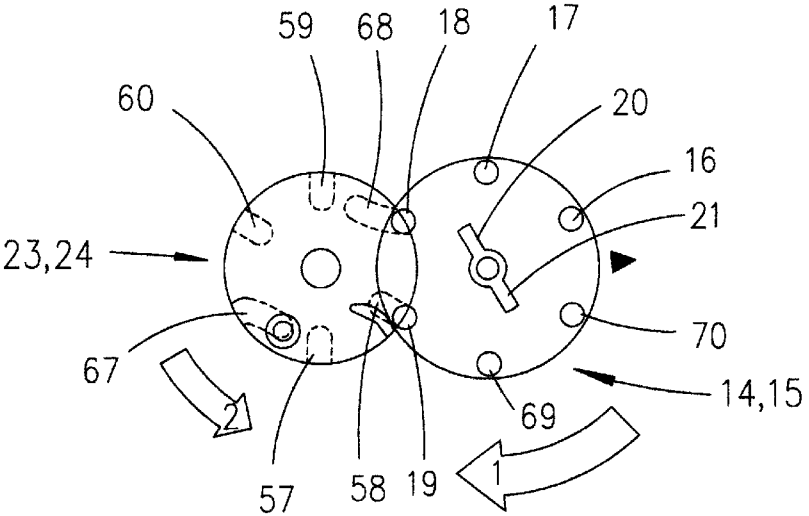
Figure 8C:
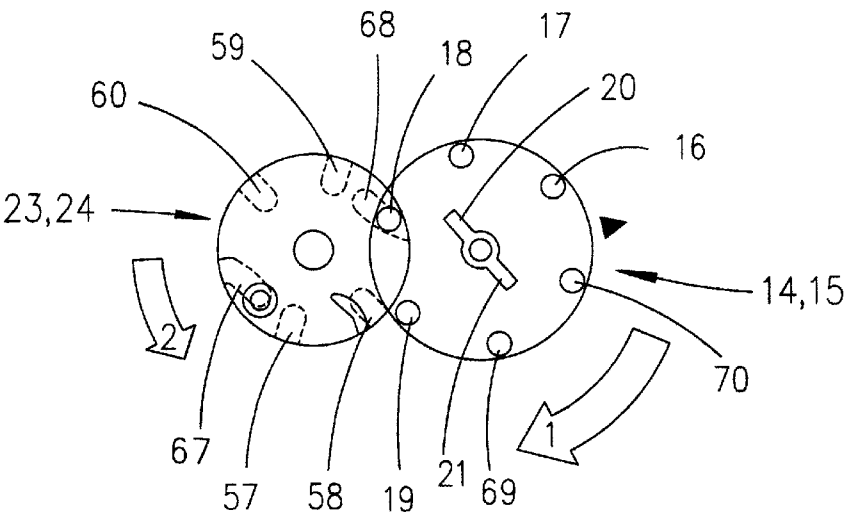

FIGS. 7A, 7B, 7C illustrates three different status of the toggle linkages 29, 30 which control the rising and receding of the sucker assembly 37. When the toggle linkages 29, 30 are actuated by the crescent cam 27 in the direction represent by arrow 5, until it passes the critical inertial point (therein when all pivot of the toggle linkages 29, 30 lie on the same axis 56 as shown in FIG. 7B), the sucker assembly 37 is forced to thrust outward in direction 6 and is locked in place before its adherent limb land the surface. While the cam 27 advances onwards, toggle linkage 30 is released in direction 7. The compression spring seated against the rib 41 will instantly thrust the limb against the surface firmly in direction 8; this procedure establish a taut interaction between the surface and the limb to ensure the stroke of alternative limb will be carried out accurately and smoothly.

Reference is now made to FIGS. 8A, 8B, 8C, 8D, which describes how the geneva wheels 23, 24 response, respectively, to the driving wheels 14, 15 in various axial position. A small triangle denotes the axial position of the driving wheel, while two arrows 1, 2 describe the direction of revolving. Four linear grooves 57, 58, 59, 60 plus two curved grooves 67, 68 (shown in FIGS. 8A–8D) are built in defined pattern on the inner facet of the geneva wheels 23, 24. When the driving stud 18 is admitted in groove 68 and starts driving the geneva wheel before it reaches a point reflected in FIG. 8B, the geneva wheel remains stationary since the forefront of the curvature of the groove 68 copies the loci of the driving studs 16, 17, 18, 19, 69, 70. It is within this period that ample time is provided for the sucker-lifting levers 32, 33 been activated by the ribs 20, 21 to release the sucker 50. While the driving wheels 14, 15 revolve onwards, the geneva wheels 23, 24 start off and revolving in varied speed until groove 68 is indexed by any driving stud in next cycle.

FIGS. 9A, 10A, 11A, 12A . . . 15A are self-explained and it illustrates different posture of the toy in sequential order. A shaded area 63 represents a vertical wall or a ceiling-floor on which the toy settled. A small triangle indicates the axial position of the driving wheels 14, 15 and an arrow 10 indicates direction of movement of the toy.

Figure 9A:
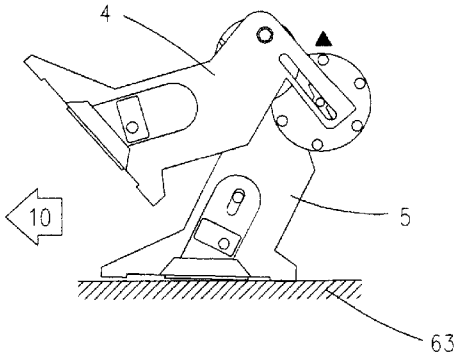
FIGS. 9A, 10A, 11A, 12A, 13A, 14A and 15A are illustrations showing different postures of the toy in sequential order in accordance with the different radial position of the driving wheel.
Figure 9B:
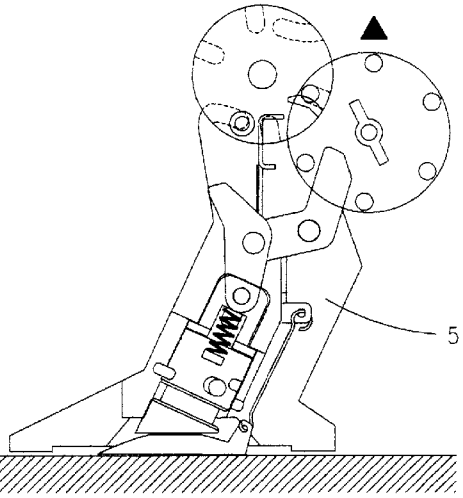
FIGS. 9B, 9C, 10B, 10C . . . 15B and 15C illustrates key elements (highlighted in bold line) involved in the mechanical movement of FIGS. 9A, 10A . . . 15A.
Figure 9C:
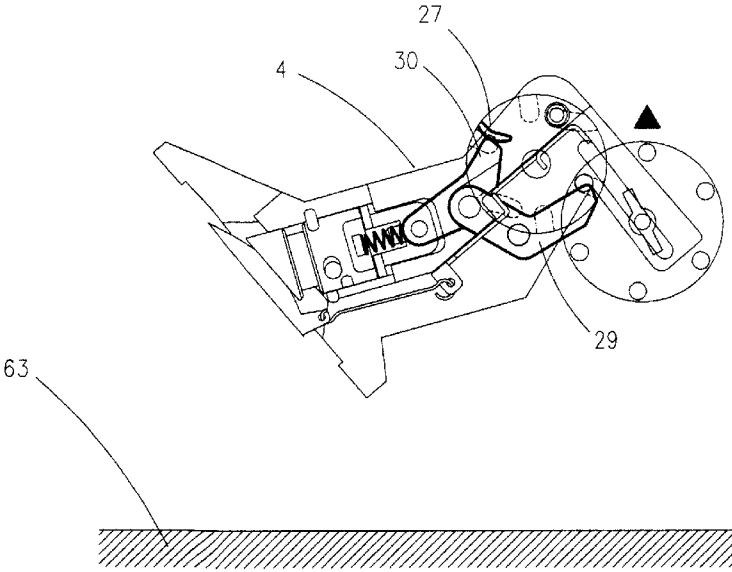
Figures 10A, 10B, 10C:
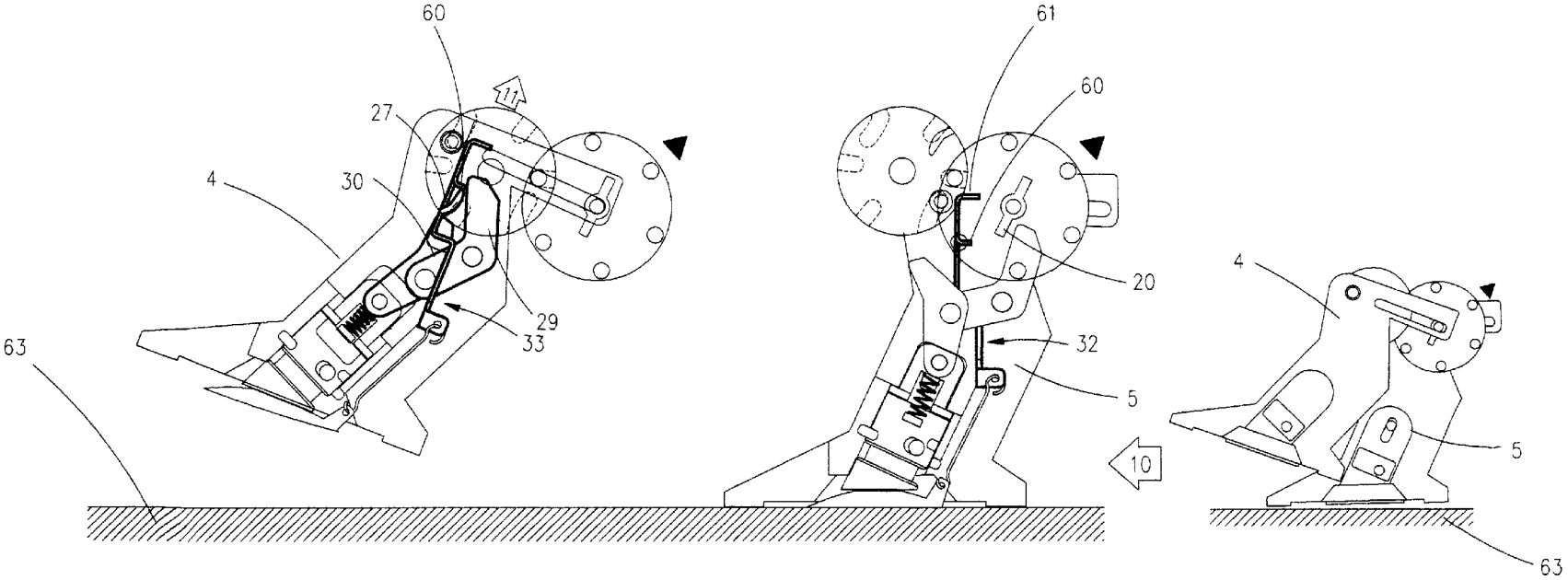
Figures 11A, 11B, 11C:
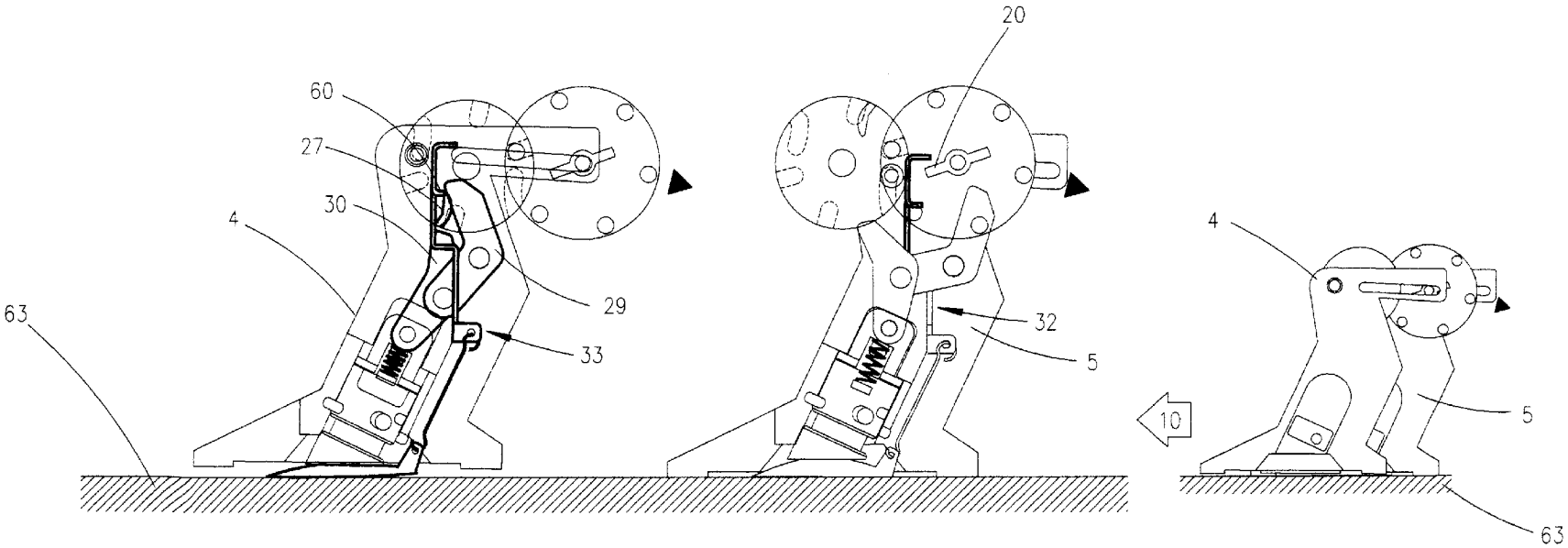
Figures 12A, 12B, 12C:
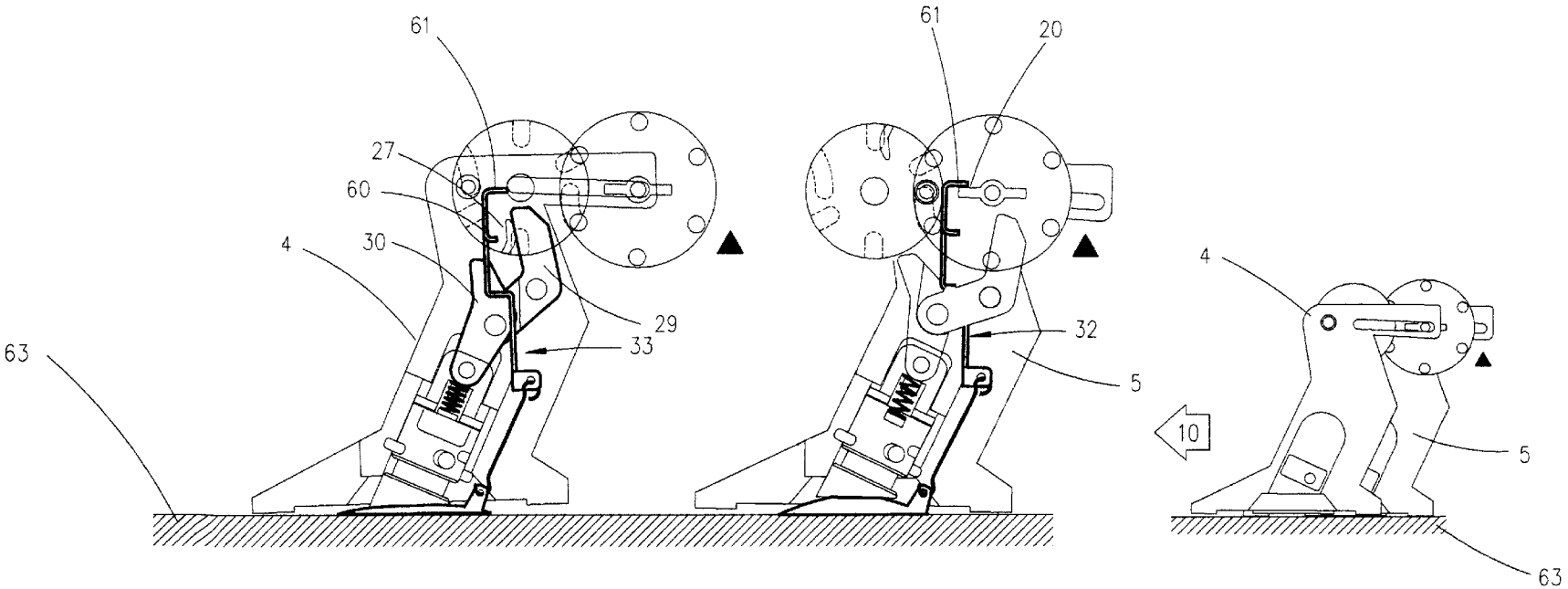
Figures 13A, 13B, 13C:
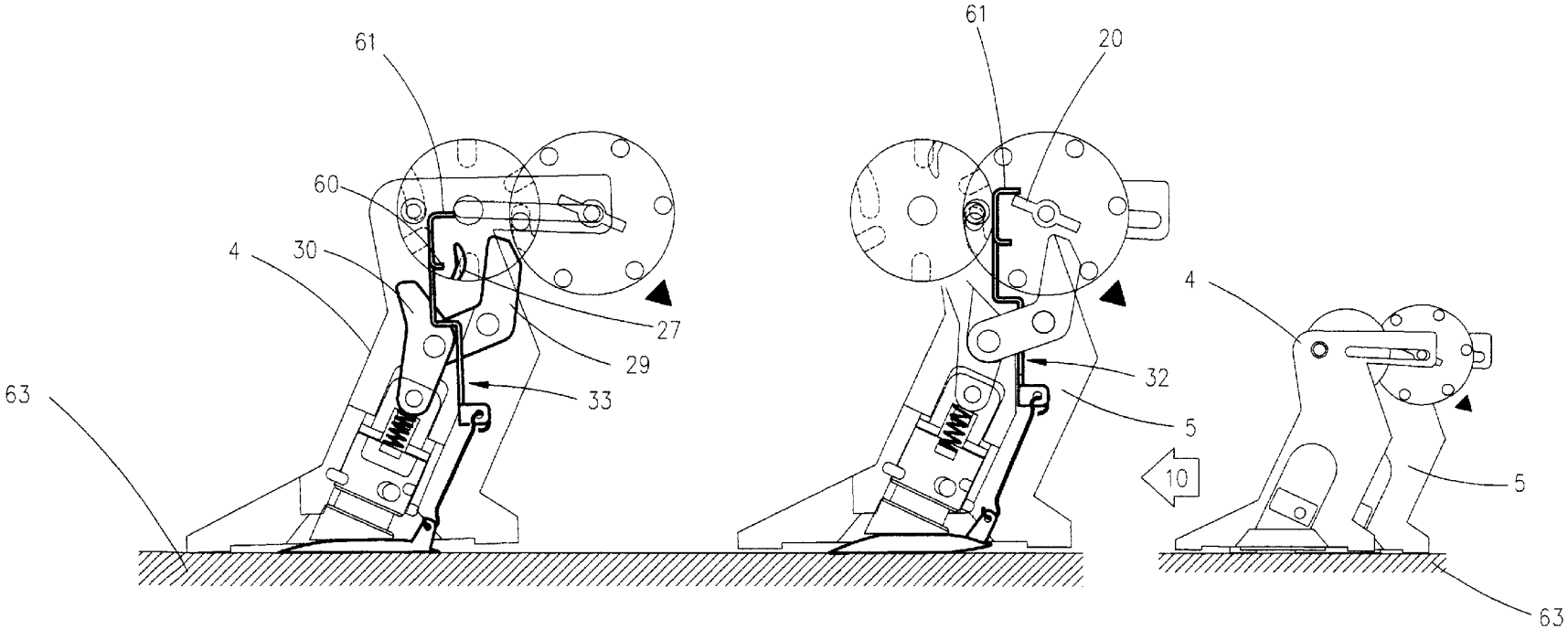
Figures 14A, 14B, 14C:
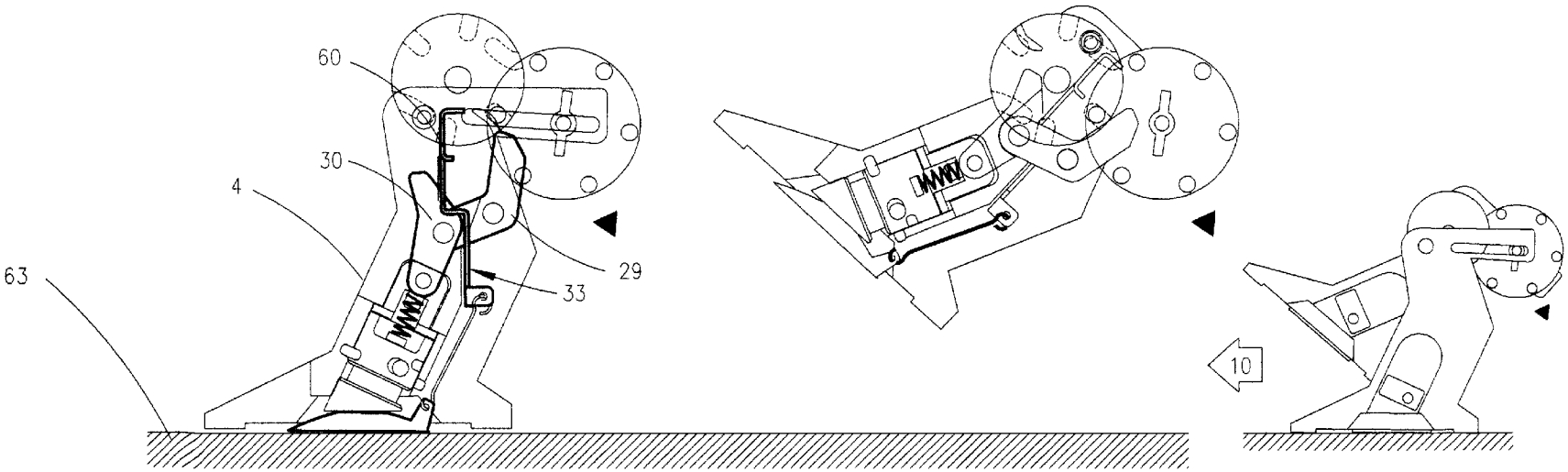
Figure 15A:
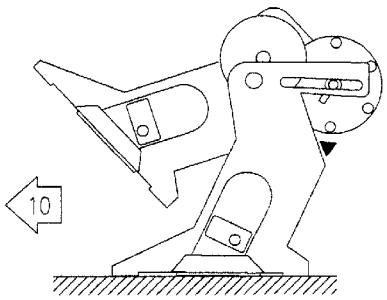
Figure 15B:
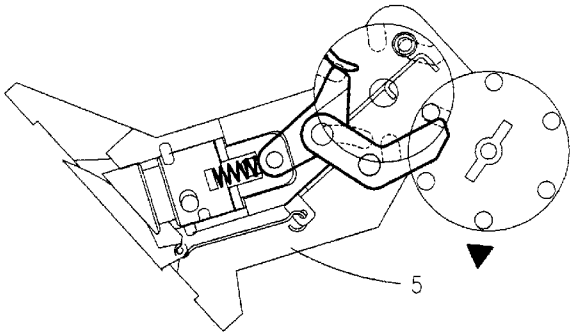
Figure 15C:
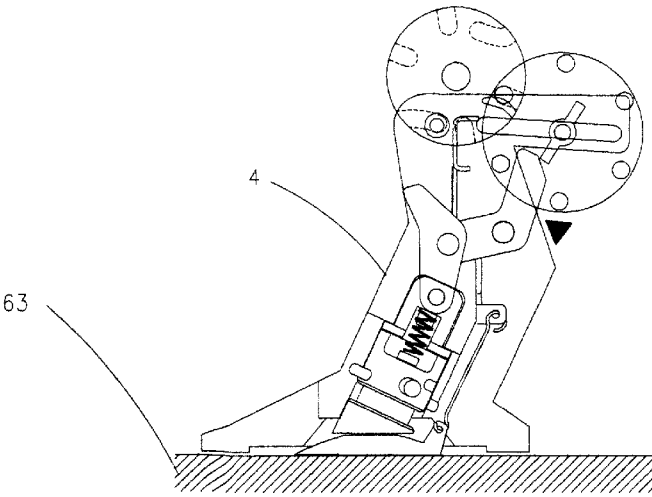

FIGS. 9B, 9C, 10B, 10C . . . 15B, 15C described key components in details in respect to the postures revealed in FIGS. 9A . . . 15A. In FIG. 9B, the limb 5 of the toy in accordance with the present invention is stuck manually onto a vertical plane when power is off. After the power is switched on, the limb 4 that hovers in the air starts to attack the plane 63. At this point the crescent cam 27 actuates the toggle-linkages 29, 30 to shove the sucker assembly 37 (FIG. 9C). In FIG. 10C, toggle linkage locks the sucker assembly 37 in place and at the same moment sucker-lifting levers 32, 33 are lifted slightly by the crescent cam 27 in direction 11 to yield a potency of settling the limb on the surface. When the crescent cam 27 leaves the edge of the tab 60 of the lifting lever (FIGS. 11C and 12C), the lever 33 is released, and as a consequence, the brim of the sucker 50 is lowered and a firm clinching of limb 4 is secured. At this very moment, the crescent cam 27 tends to push and release the toggle linkages 29, 30 therein the spring 40 force the limb 4 to press against the surface 63 (FIG. 13C). At the same time, the rib 20 (or 21) advances and poses underneath the tab 61 of the sucker-lifting lever 32 disposed in limb 5 and starts to lift up the lever (FIG. 12B). Before successfully releasing the sucker 50, the limb 5 and the geneva wheel 23 remains motionless (FIG. 13B) until the driving wheel 14 reaches a point reflected by FIG. 8B, from thereon the limb 5 starts to lift off and leave the limb 4 firmly attached onto the plane 63 (FIGS. 14B, 14C, 15B, 15C).

The present invention has been disclosed in preferred forms and the drawing figures are for illustrative purposes only. It is therefore intended to cover modifications and variations of the mechanical structure, which yield equivalent or similar results, within the spirit and scope of the invention defined by the appended claims.

What is claimed is:

1. A device employed in motorized toys comprising:

a motor-driven mechanism; and a pair of mechanical limbs driven and governed by said motor-driven mechanism, wherein each mechanical limb comprises a resilient sucker movably seated at the bottom of the limb, and said motor-driven mechanism is operative to drive the said mechanical limbs along a defined path, wherein said motor-driven mechanism comprises a gearbox, operative to drive a pair of driving wheels seated on both sides of said gearbox, said device further comprising a gear-engaging shaft protruding from the gearbox for coupling said driving wheels, and a pair of geneva wheels coupled and driven by said driving wheels, and wherein each geneva wheel is provided with a plurality of slots in different transversal curvatures to achieve intermittent maneuver and variant velocity of revolving.

2. The device employed in motorized toys according to claim 1 wherein each driving wheel comprises a plurality of constituent driving studs projecting outwardly from a facet of said driving wheel and dispersed in a polar array with the common center concentric with the axle of the gear-engaging shaft.

3. The device employed in motorized toys according to claim 1 wherein each driving wheel comprises a concentric pin projecting from a facet thereof, for purpose of delimiting certain mechanical movement of a respective one of the limbs.

4. A device employed in motorized toys comprising:

a motor-driven mechanism; and a pair of mechanical limbs driven and governed by said motor-driven mechanism, wherein each mechanical limb comprises a resilient sucker movably seated at the bottom of the limb, and said motor-driven mechanism is operative to drive the said mechanical limbs along a defined path, wherein said motor-driven mechanism comprises a gearbox, operative to drive a pair of driving wheels seated on both sides of said gearbox, said device further comprising a gear-engaging shaft protruding from the gearbox for coupling said driving wheels, and a pair of geneva wheels coupled and driven by said driving wheels, and wherein each limb further comprises a toggle linkage, and each geneva wheel comprises a cam in crescent shape located on a facet of said geneva wheel, said cam being operative to actuate and release said toggle linkage, and said cam of each geneva wheel being operative to elevate a lever linking to a respective one of said resilient suckers.

5. The device employed in motorized toys according to claim 4 wherein each limb further comprises a sucker-assembly operative to adjust the rising and receding of said respective resilient sucker, and said toggle linkage of each limb is operative to shove and retract a respective one of said sucker-assemblies in respective of operative position of the crescent-shaped cam of a respective one of said geneva wheels.

6. The device employed in motorized toys according to claim 5 wherein said sucker-assembly of each limb comprises a sleeve, cubical shank to be fitted in said sleeve, an actuator and a swivel base.

7. A device employed in motorized toys comprising:

a motor-driven mechanism; and a pair of mechanical limbs driven and governed by said motor-driven mechanism, wherein each mechanical limb comprises a resilient sucker movably seated at the bottom of the limb, and said motor-driven mechanism is operative to drive the said mechanical limbs along a defined path, wherein each limb comprises a sucker-lifting lever linked to a respective one of said resilient suckers, and wherein said sucker-lifting lever of each limb is formed with a plurality of lifting tabs on an upper portion thereof and one bent tab at a lower portion thereof, said bent tab being linked to the respective resilient sucker.

8. The device employed in motorized toys according to claim 7 wherein each driving wheel comprises at least one rib extending outwardly from the axle of the driving wheel, said rib being used to lift a respective one of said sucker-lifting levers.

9. The device employed in motorized toys according to claim 3 wherein an elongated slot is built in each limb to accommodate the concentric pin of a respective one of the driving wheels.

10. A driving device for a toy comprising:

a pair of feet for moving a toy along a surface, each of said feet including a hollow limb, a suction cup movably received in said limb of said each feet for movement along a longitudinal axis between a receded position where said suction cup is within said limb and a lowered position where said suction cup projects outwardly from an lower end of said limb, and a spring for urging said suction cup toward said receded position;

means for driving said feet along a defined locus to bring said suction cups alternately into attachment to a surface; and means for moving and retaining each of said suction cups to and at said lowered position during cup-attaching movement of a respective one of said feet and for releasing said each suction cup from said lowered position upon completion of said attachment.

11. The driving device according to claim 10 wherein said each suction cup is movably connected to a respective limb through toggle linkages.

12. The driving device according to claim 11 wherein said driving means comprises a pair of first rotational wheels operatively connected respectively to said feet, and said moving means comprises said toggle linkages, said toggle linkages being pivotally connected to said respective limb such that said toggle linkages pivot to move said each suction cup in response to part of movement of a respective one of said first wheels.

13. The driving device according to claim 12 wherein said driving means further comprises a motor operatively connected to said fist wheels, and a pair of second rotational wheels arranged for operative engagement respectively with said first wheels, and said feet are pivotally mounted respectively on said second wheels.

14. The driving device according to claim 13 wherein each of said first wheels comprises a plurality of engaging studs projecting outwardly therefrom and arranged in a polar array with a common center concentric with a rotational axis of said each first wheel, and each of said second wheels has plurality of slots for operative engagement with said studs, said slots of said each second wheel having different transversal curvatures to achieve intermittent maneuver and variant revolving velocity of said each second wheel.

15. The driving device according to claim 13 wherein each of said second wheels comprises a cam located thereon for operative engagement with said toggle linkages of a respective moving means so that when engaged by said cam, said toggle linkages move and retain a respective suction cup to and at said lowered position.

16. A driving device for a toy comprising:

a pair of feet for moving a toy along a surface, each of said feet including a hollow limb, and a suction cup movably received in said limb for movement along a longitudinal axis between a receded position where said suction cup is within said limb and a lowered position where said suction cup projects outwardly from an lower end of said limb;

means for driving said feet along a defined locus to bring said feet alternately into contact with a surface; and means for manually selecting either one of said receded and lowered positions for each suction cup so that said each suction cup is locked in said one position during operation of said device.

17. The driving device according to claim 16 wherein said selecting means comprises a manually operable swivel member received in a respective limb for swiveling movement about said longitudinal axis, a connecting member secured to a respective suction cup and movably connected to said swivel member for linear movement along said longitudinal axis, and means for converting said swiveling movement of said swivel member into said linear movement of said connecting member.

18. The driving device according to claim 17 wherein said converting means comprises at least one pin on said connecting means and at least one S-shaped slot in said swivel member, said pin being received in said slot such that said pin is guided by said slot upon said swiveling movement of said swivel member to bring said respective suction cup into a selected one of said positions.

19. A driving device for a toy comprising;

a pair of feet for moving a toy along a surface, each of said feet including a limb, a suction cup connected to a lower end of each said limb;

means for driving said feet along a defined locus to bring each said suction cup alternately into attachment to a surface and to subsequently move each said suction cup alternately away from said surface for detachment of said suction cup from said surface;

means for lifting a brim of each of said suction cups in advance of cup-attaching movement of a respective one of said feet;

wherein said lifting means is further adapted to lift said brim of each said suction cup in advance of cup-detaching movement of each said respective foot;

said driving means comprises a motor, and a pair of first rotational wheels each operatively connected to said motor and to said feet; and said lifting means comprises at least one rib formed on a respective one of said first wheels so that said brim of said each suction cup is lifted in response to part of a rotational movement of said respective first wheel.

20. The device according to claim 19 wherein said rib of said respective first wheel extends outwardly from an axle of said respective first wheel.

21. The device according to claim 19 wherein said lifting means comprises a lifting lever linked to a respective one of said suction cups, said lifting lever being movably connected to a respective one of said limbs for movement between a lower position and an upper position where said lifting lever lifts said brim of said respective suction cup, and said rib of said respective first wheel is located for operative engagement with respective one of said lifting levers so that when engaged by said rib, said respective lifting lever is moved to said upper position.

22. The device according to claim 19 wherein said driving means further comprises a pair of second rotational wheels arranged for operative engagement respectively with said first wheels, said feet are pivotally mounted respectively on said second wheels, and said lifting means further comprises a cam formed on a respective one of said second wheels so that said brim is lifted in response to part of rotational movement of said respective second wheel.

* * * * *